US005305884A

United States Patent [19]

Apps et al.

[11] Patent Number: 5,305,884

[45] Date of Patent: Apr. 26, 1994

[54] DUAL PURPOSE LOW DEPTH NESTABLE TRAY

[75] Inventors: William P. Apps, Anaheim; Jonathan A. Kalin, Manhattan Beach, both of Calif.

[73] Assignee: Rehrig Pacific Company, Inc., Los Angles, Calif.

[21] Appl. No.: 963,678

[22] Filed: Oct. 20, 1992

[51] Int. Cl.[5] ..... B65D 21/00

[52] U.S. Cl. ..... 206/519; 206/505; 206/515; 220/509; 220/519

[58] Field of Search ..... 206/515, 503, 505, 519; 220/515, 519, 509

[56] References Cited

U.S. PATENT DOCUMENTS

| | | | |
|---|---|---|---|
| 3,333,727 | 8/1967 | Belcher et al. . | |
| 3,360,162 | 12/1967 | Miles | 206/505 |
| 3,391,814 | 7/1968 | Box . | |
| 3,613,943 | 10/1971 | Bridenstine | 206/507 |
| 3,642,168 | 2/1972 | Wiley, Jr. et al. . | |
| 3,701,449 | 10/1972 | Schoeller et al. | 220/519 |
| 3,734,341 | 5/1973 | Levenhagen | 206/507 |
| 3,791,549 | 2/1974 | Delbrouck et al. | 206/509 |
| 4,162,738 | 7/1979 | Wright | 220/519 |
| 4,700,837 | 10/1987 | Hammett . | |
| 4,867,313 | 9/1989 | Padoyani | 206/519 |
| 5,184,748 | 2/1993 | Apps | 220/519 |

FOREIGN PATENT DOCUMENTS

| | | |
|---|---|---|
| WO90/1575-78 | 12/1990 | PCT Int'l Appl. . |
| 1182452 | 2/1970 | United Kingdom . |

*Primary Examiner*—Steven M. Pollard

*Attorney, Agent, or Firm*—Banner, Birch, McKie & Beckett

[57] ABSTRACT

A dual purpose low depth nestable tray for holding either cans or bottles of similar capacities with structural features that prevent spreading or fraying of the walls. The tray comprises a floor, a band around the periphery of the tray and columns interconnecting the band to the floor. A nesting nub is disposed on the floor and nesting ledges are disposed on at least one column along each side of the wall structure. The nub and ledges are equal in height and act as supports for the weight of a stack of nested empty trays which prevents the walls from having to support the weight and results in the walls maintaining their shape and structural integrity. The floor is configured with support areas for the containers and has features for accommodating both bottles and cans. The support areas have a circular groove for engaging the bottoms of cans and the bottom surface of the floor has downwardly projecting redoubts for facilitating stacking and handling of trays loaded with cans. The floor bottom surface also has upward recesses for loosely containing the tops of bottles when the trays are loaded with bottles and stacked or cross-stacked.

33 Claims, 10 Drawing Sheets

DUAL PURPOSE LOW DEPTH NESTABLE TRAY

BACKGROUND OF THE INVENTION

The present invention relates to a multi-purpose low depth, nestable tray for transporting and storing different types of beverage containers having similar capacities, such as twelve-ounce aluminum cans and twelve-ounce PET plastic bottles.

Cans and bottles for soft drinks, beer and other beverages are often stored and transported during the distribution stages thereof in trays or boxes. Previously, for single serving sized cans and bottles such as those which hold twelve fluid ounces, a different type of tray was required for each type of container. Trays are generally configured for one type of container, and loaded trays that hold bottles and ones that hold cans cannot generally be used together or stacked. Thus, there has been a need for a multi-purpose returnable and reusable tray for storing, displaying and transporting cans and/or bottles which is light weight, easy to handle and economical. The prior art does not provide a multi-purpose tray which can accommodate both single serving sized cans and bottles.

Examples of returnable and reusable single purpose trays are disclosed in U.S. Pat. No. 4,932,532; and No. 4,823,955; and No. 5,031,774. The previous trays are configured for use with cans only or two-liter plastic bottles only. A bottler or distributor which uses both single serve cans and bottles must use different types of trays, thus adding to expense and inefficiency.

Plastic low depth cases have been developed wherein the side walls are lower than the height of the stored containers. Since containers placed in the cases would extend above the side walls, the containers in a lower case support the weight of the other cases stacked on top of them. Metal cans generally have the structural integrity to bear the compressive loads of loaded and stacked trays. For bottles, a popular plastic, polyethylene terephthalate or PET is used for its transparency, light weight and relatively low cost. Although PET bottles are flexible, the walls can bear high compressive loads as long as these loads are applied axially. Thus, it is important that the bottles do not tip in the trays which can mean a non-axial compressive load which can result in buckling.

Some major problems experienced with previous nestable trays are spreading or fraying of the side walls and "shingling" between trays placed in close side-by-side or end-to-end relation. The spreading or fraying problem often compounds the "shingling" problem. The present invention addresses both of these frequent complaints of previous trays. Structural supports to prevent spreading or fraying of the side walls are provided, which in turn help alleviate the "shingling" problem. Moreover, the side walls of the present tray are provided with additional structural improvements to avoid "shingling."

As to "shingling," previous nestable trays, which have nesting tabs or ribs on the exterior of the side walls, often are not easily handled because the tabs or ribs on the exterior of the side walls provide a catch surface between trays which come into contact. When stacks of trays are placed in close side-by-side and end-to-end relation, any catch surface such as a rib or tab on the will tend to land and rest on the upper edge or rim of the band of a neighboring tray. This overlapping of adjacent trays causes one end of the tray to be raised with respect to the other and is commonly referred to as "shingling". Shingling is disruptive of load stability on a pallet since it initially prevents the achievement of a perfectly squared load. Stacks which are unstable because of shingling are undesirable and can be a hazard. There exists a need for a nestable tray which is constructed to avoid shingling.

Spreading or fraying of side wall structures from nesting is a problem encountered with previous nestable trays. When a large number of trays are nested, the side walls of the trays near the bottom of the nested stack, which bear more of the load, have a tendency to spread or splay outward because no structural provision has been made for supporting the weight of trays nested above. This damage has a cumulative effect and results in a shorter service life for the trays, and thus additional expense for replacement. The shingling problem can be compounded in trays having no provision to prevent spreading or fraying. Any nesting tabs or ribs on the exterior of the side walls are even more prone to shingling or catching on other trays as the side walls spread outward. There has been a need for trays which maintain their structural integrity over repeated uses in both nested and loaded configurations. The present invention addresses the spreading problem by providing structural features to support the weight of stacked and nested trays. Since shingling is often compounded by spreading, this improvement alone would greatly alleviate the shingling problem. Moreover, as discussed above, the present tray also provides structural features on the outside of the side wails to prevent shingling.

Another problem encountered in using previous trays, particularly for cans, has been damage to the sides of the cans, ranging from slight scratches to more severe dents and even ruptures, from excessive contact with the wails of the trays during handling and transport. Simply the operating vibration of a truck containing the loaded trays can cause damage to the cans if there is excessive contact and rubbing between the walls of the tray and the cans. There is a need for a tray which can hold cans in spaced relation to one another and the wan structure to prevent damage to the cans and to other types of containers as well.

SUMMARY OF THE INVENTION

Accordingly, it is a principal object of the present invention to provide a multi-purpose nestable, low depth tray for storing, displaying and transporting different types of containers, such as single serve bottles or cans. The tray of the present invention combines the features adapted to accommodate cans and bottles into a single tray.

Another object of the present invention is to provide a low depth, nestable tray which has sufficient structural features to prevent the side walls of the tray from spreading or fraying due to the weight of trays nested above it.

Still another object of the present invention is to provide a low depth, nestable tray which avoids shingling or catching on other trays during handling.

A further object of the present invention is to provide a low depth tray which is securely supported when loaded and stacked on another loaded tray beneath, but can easily be moved along the tops of the containers, particularly can tops.

A still further object of the present invention is to provide a low depth nestable tray which makes efficient use of space both when loaded and stacked and when empty and nested.

Another object of the present invention is to provide a low depth, nestable tray which holds the containers spaced apart from one another and from the wall structure of the tray to prevent any damage to the containers from excessive contact.

Directed to achieving these objects, a new multi-purpose or dual purpose low depth, nestable tray for different types of containers is herein provided. The preferred configuration is for single serve sized cans and bottles. This tray is formed by integrally molding from plastic, three basic components—a floor, a band and a plurality of columns interconnecting the band and floor.

The floor preferably has an open lattice design which not only allows unwanted fluids to drain out of the tray, but also requires less material and thus is lighter than a solid floor design. The floor also has container support areas sized to receive either cans or bottles, and may include a shallow groove for engaging the bottoms of cans. The floor preferably also has at least one integral nub which projects upward and acts as a support for trays nested above it.

The floor of the tray has an outer or bottom surface which is configured for accommodating the tops of either cans or bottles in a tray underneath. The floor bottom surface has upwardly recessed receiving areas for loosely containing the tops of bottles, and downwardly projecting redoubts which block a tray from sliding along the tops of cans in a tray underneath it. In this way, the floor bottom surface of the tray is configured for use with both cans and bottles.

The band is substantially upright and extends around the periphery of the tray forming a wall structure. The band is positioned above the floor so as to be below the tops of the containers when the containers are positioned on the floor of the tray. However, the low depth arrangement is high enough relative to the containers to prevent them from tipping. The band is substantially flat and is designed specifically to avoid contact with the containers. The exterior lower surface is smoothly beveled inward and downward so as to provide no extension or surface which can catch or shingle on another tray.

The columns extend between, interconnect, and merge the floor with the band. They are spaced around the periphery of the floor between adjacent support areas. The areas between the adjacent columns and between the band and floor along the sides are open, providing a light weight design allowing for visualization and display of the containers held in the tray. At least one column along each side wall preferably has a nesting ledge on the interior and a rib on the exterior which are equal in height to the nub, and which also act as structural support for trays nested above it.

These and other features and advantages of the invention may be more completely understood from the following detailed description of the preferred embodiments of the invention with reference to the accompanying drawings.

DETAILED DESCRIPTION OF THE PREFERRED EMBODIMENT

Figure 1:
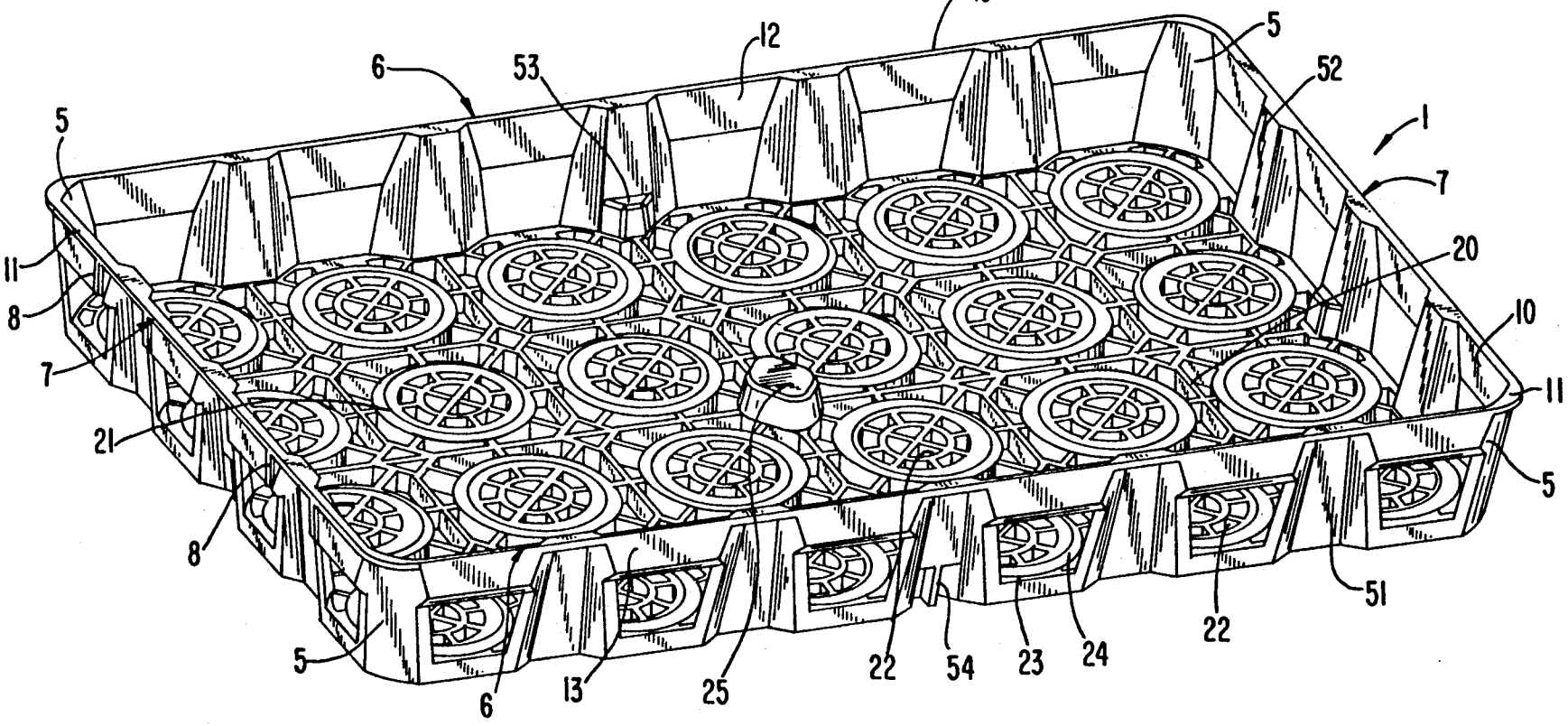
FIG. 1 is a perspective view of the top of the tray in accordance with the present invention.
Figure 2:
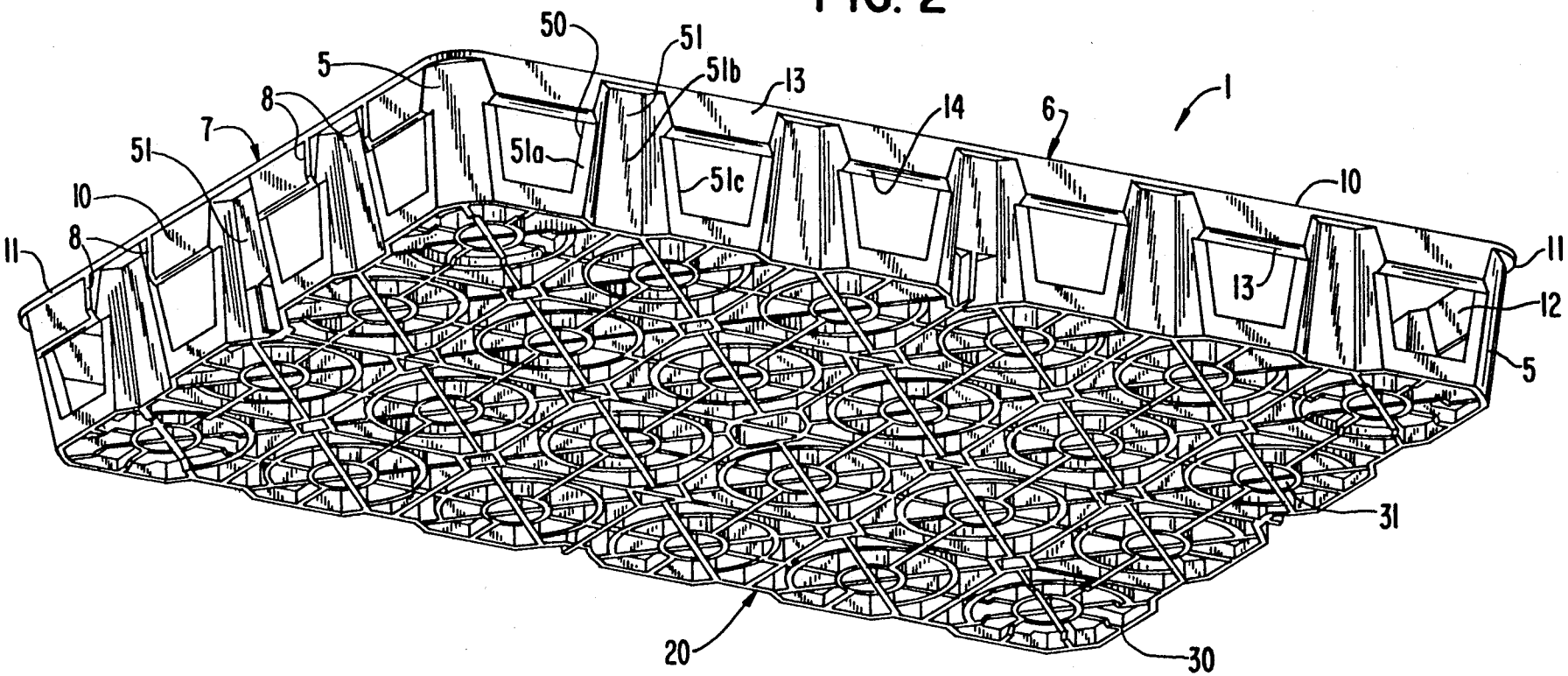
FIG. 2 is a perspective view of the bottom of the tray in accordance with the present invention.

The present invention is a single tray which can be used to hold bottles and cans of similar capacity, and is especially adaptable for twelve-ounce metal or aluminum cans and PET bottles. Of course a tray should contain only cans or only bottles, but trays of cans may be stacked with trays of bottles. Referring to FIGS. 1 and 2, the tray I of the present invention comprises three basic elements, a band 10, a floor 20, and a plurality of columns 50. The wall structure that defines the periphery of the tray I comprises the band 10 which is generally vertical and above the floor 20, and is spaced above and connected to the floor 20 by a plurality of columns 50. The columns 50 are arranged along the sides of the tray 1. The tray I may have comer support posts 5 at each of the comers of the wail structure. The wall structure includes side walls 6 and end walls 7.

The band 10 extends around the periphery of the tray 1. Band 10 is substantially smooth along its length in the areas between the columns 50. The portion of the band 10 between the columns 50 has a generally flat interior surface 12. The interior surface 12 of band 10 is not contoured or scalloped in any way so as to avoid excessive contact with the containers when the tray I is loaded.

Since the band 10 is normally spaced apart from the sides of the containers, damage due to excessive contact between the containers and the band is prevented. The spaced apart relationship between the containers and the band 10 also provides a protective zone around the perimeter of the loaded containers which prevents external forces from impacting and damaging the containers. The band 10 is flexible so as to flex upon impact and thereby prevent the containers from being substantially affected by the external forces.

Figure 5:
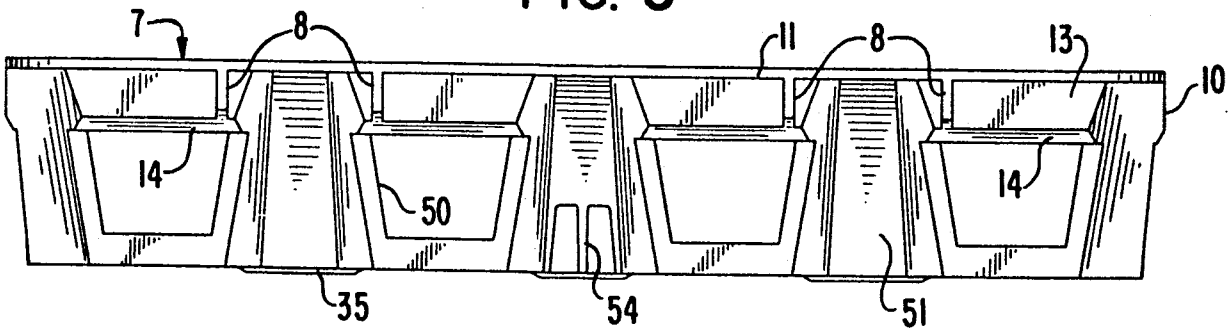
FIG. 5 is an elevational view of an end wall of the tray.
Figure 9:
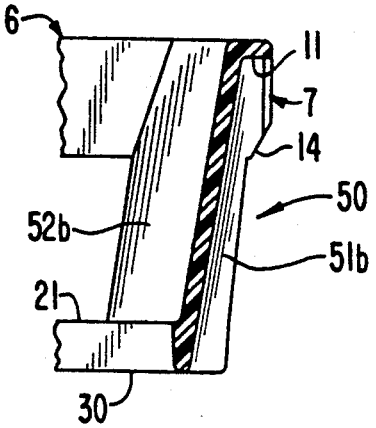
FIG. 9 is a cross section taken along line 9—9 of FIG. 3.
Figure 10:
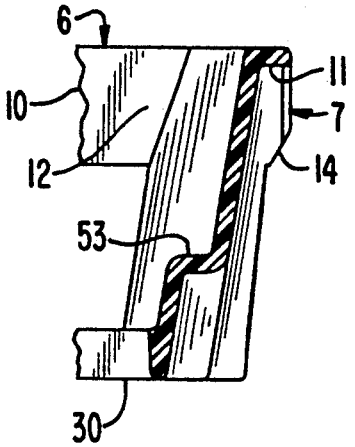
FIG. 10 is a cross section taken along line 10—10 of FIG. 3.

The portion of the band 10 between the columns 50 has a generally flat exterior surface 13. The lowermost portion of the exterior surface 13 has a smooth, downwardly and inwardly inclined beveled or cam surface 14 best shown in FIGS. 9 and 10. The beveled or cam surface 14 is important in preventing the shingling problems of previous trays. The beveled surface 14 provides a cam surface, which when in contact with the lip or top edge of an adjacent, tray tends to drop down without resting on the adjacent top edge. To further prevent shingling, the lip 11 of the end walls 7 of the present tray is preferably provided with a plurality of end wall ribs 8, best shown in FIGS. 2 and 5, which follow the bevel 14 of the lowermost portion of the exterior surface 13 of the band 10. The end wall ribs 8 of the end walls 7 will tend to cam downward when in contact with the top edge of an adjacent tray, thereby preventing the end walls 7 from resting on the adjacent tray. Any other structural feature disposed on the exterior of the band 10 should also be downwardly and inwardly inclined such as the beveled or cam surface 14 so as to avoid providing a catch surface prevalent in trays which have shingling problems.

Referring to FIGS. 1, 2, 4, 5, 9 and 11, the top of the band 10 along the side walls 6 preferably is slightly different than along the end walls 7. Along the exterior of the side walls 6, the top of the band 10 and the top portions of the columns 50 are substantially flush. However, along the exterior of the end walls 7, the top of the band 10 and the top portions of the columns 50 have a lip 11 at the top of the end walls, best shown in FIGS. 2, 5, 9 and I 0. The lip 1 1 forms a slight overhang over the slots 51 as well as over the comer posts 5.

Figure 3:
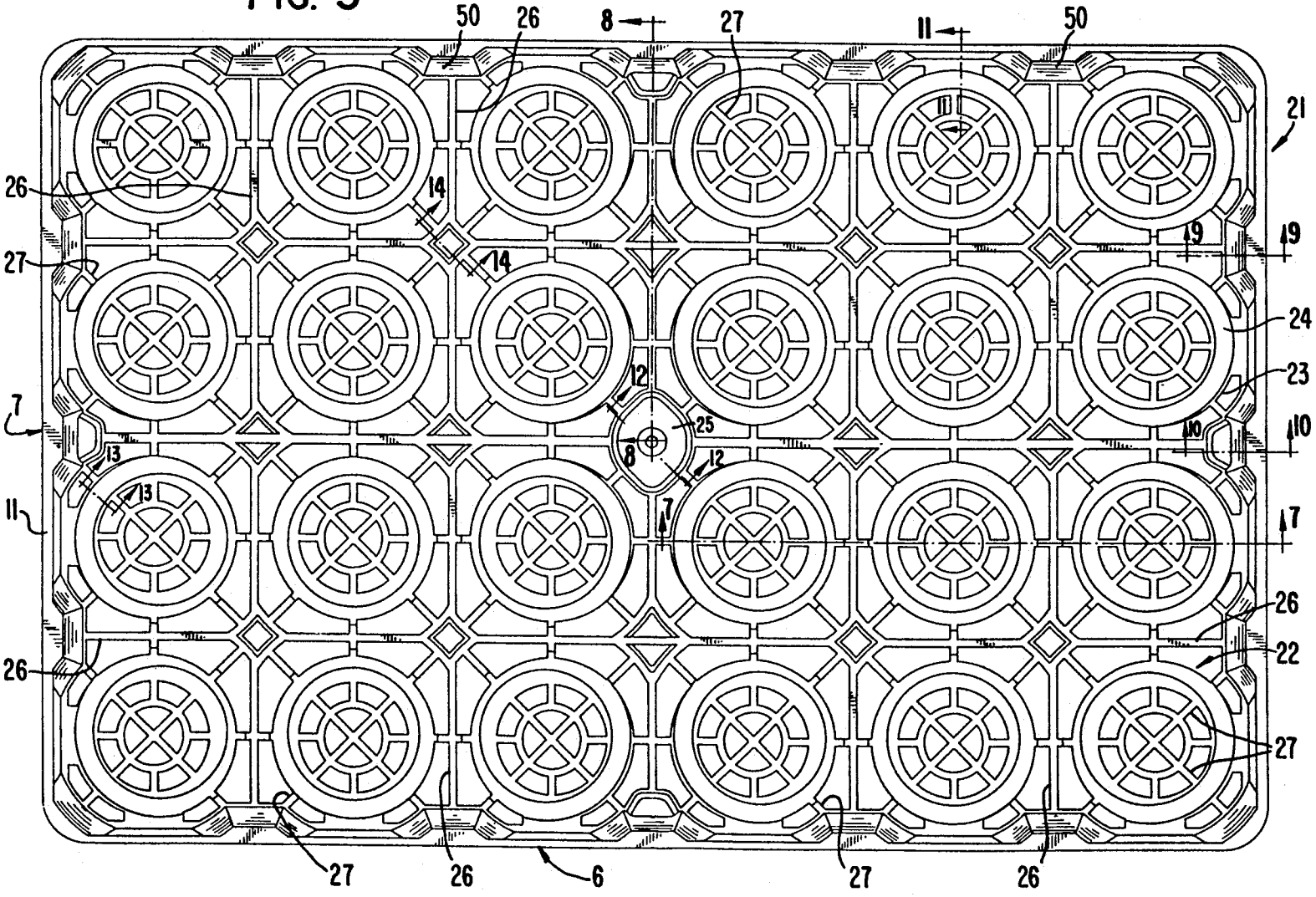
FIG. 3 is a top plan view of the tray.
Figure 4:
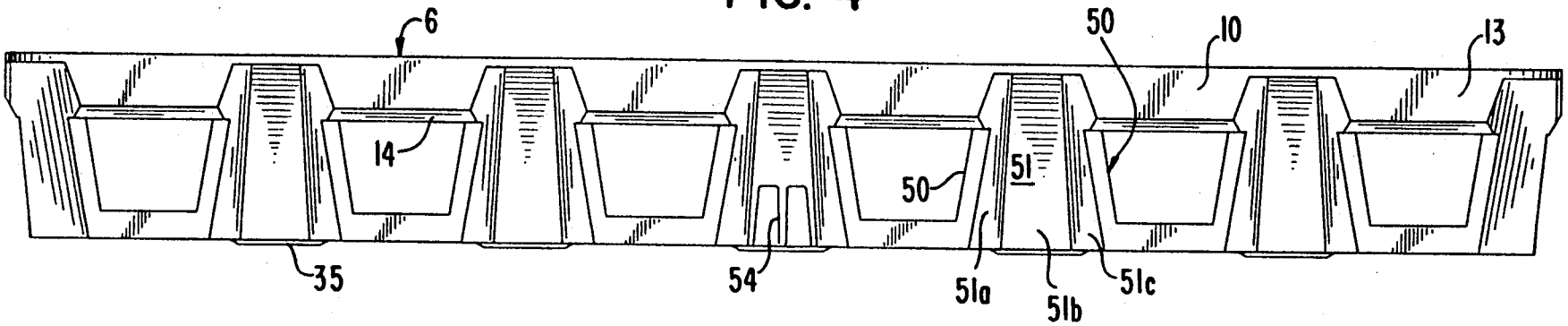
FIG. 4 is an elevational view of a side wall of the tray.

The floor 20 preferably has a lattice-like configuration having a pattern of open spaces as shown in FIGS. 1-3 and 6. The open floor design provides a light weight tray, and is practical for allowing any liquids to drain through the floor 20. Referring specifically to FIG. 3, the floor 20 has an upper or top surface 21 defining a plurality of preferably circular support areas 22 for supporting containers thereon. The support areas 22 are connected to each other by a system of grid-like perpendicular struts 26 traversing the floor 20 in longitudinal and lateral directions, and radial struts 27 extending preferably radially from the circular support areas 22. The perpendicular struts 26 extend the full length and width of the floor 20, and between the rows and columns of support areas 22. The radial struts 27 then extend to or through these perpendicular struts 26. The support areas 22 are arranged in rows and columns to thereby define one or more arrays. In the preferred design, there are four two-by-three arrays to accommodate four six-packs of cans or bottles, in other words, there are a total of twenty-four support areas 22 in a four-by-six arrangement.

Figure 13:
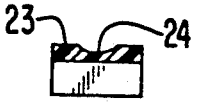
FIG. 13 is a cross section taken along line 13—13 of FIG. 3.
Figure 15:
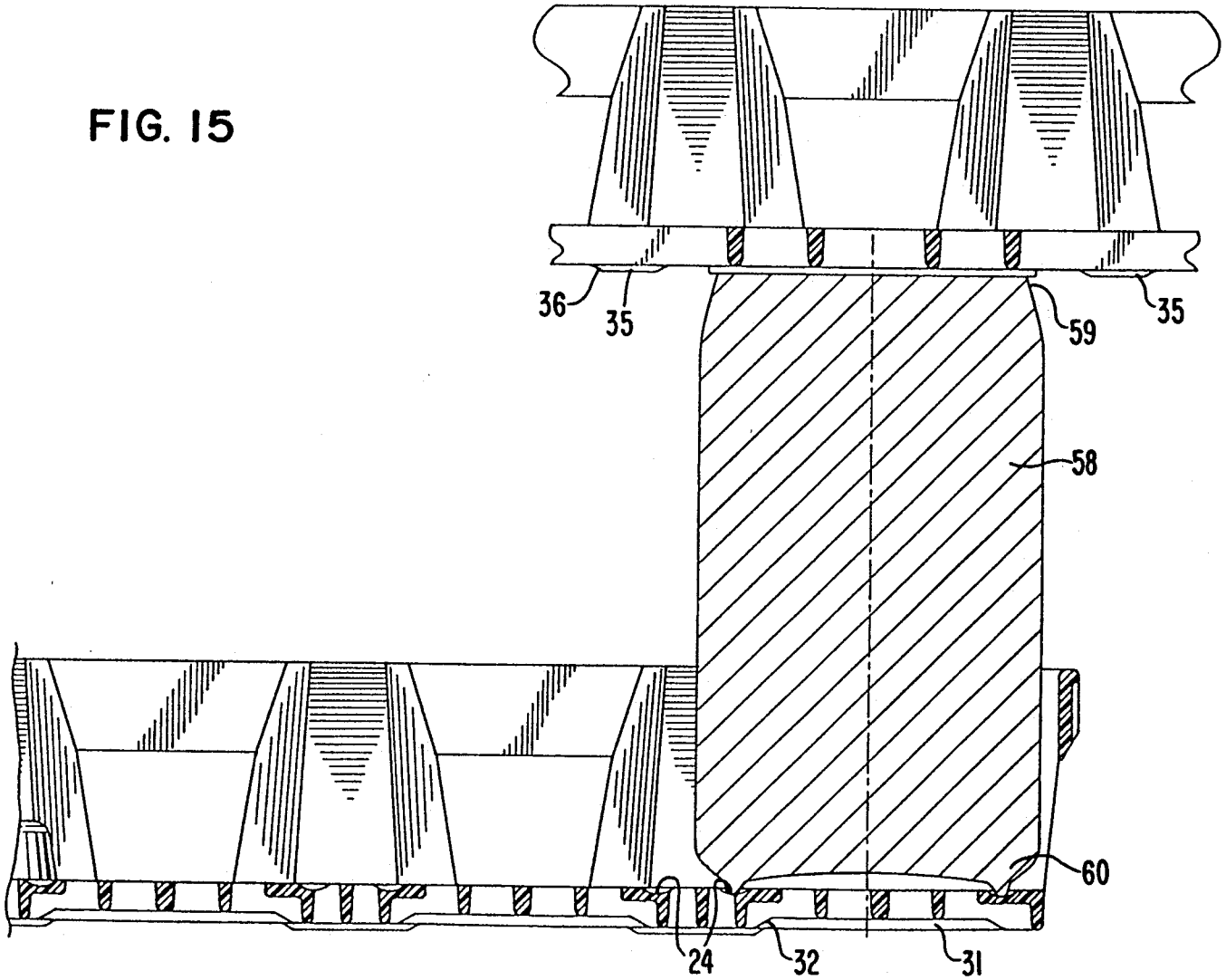
FIG. 15 is a partial elevational view of a tray stacked on top of another tray loaded with a can.

Each support area 22 is sized to hold either bottles or cans of similar capacity. Each support area 22 includes a supporting ring 23 having a relatively shallow circular groove 24 which is sized to seat or engage the circular bottom of a can as shown in FIG. 15. FIG. 13 shows a cross section of the groove. The grooves 24 seat the bottoms of the cans, keeping them in place, and thereby act to prevent the sides of the cans from being damaged due to excessive contact with the side wails. In the preferred embodiment, bottles are not engaged in the grooves 24, the grooves 24 are for seating cans. However, support areas with additional grooves or other bottle seating means is within the scope of the invention. In the preferred design which accommodates four six-packs of cans, the grooves 24 are not consistently centered on all of the rings 23. This is done in order to center each six-pack in a quadrant of the tray.

Figure 12:
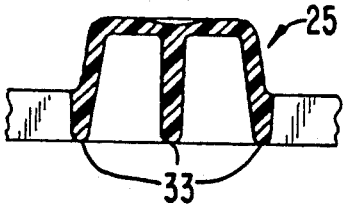
FIG. 12 is a cross section taken along line 12—12 of FIG. 3.
Figure 17:
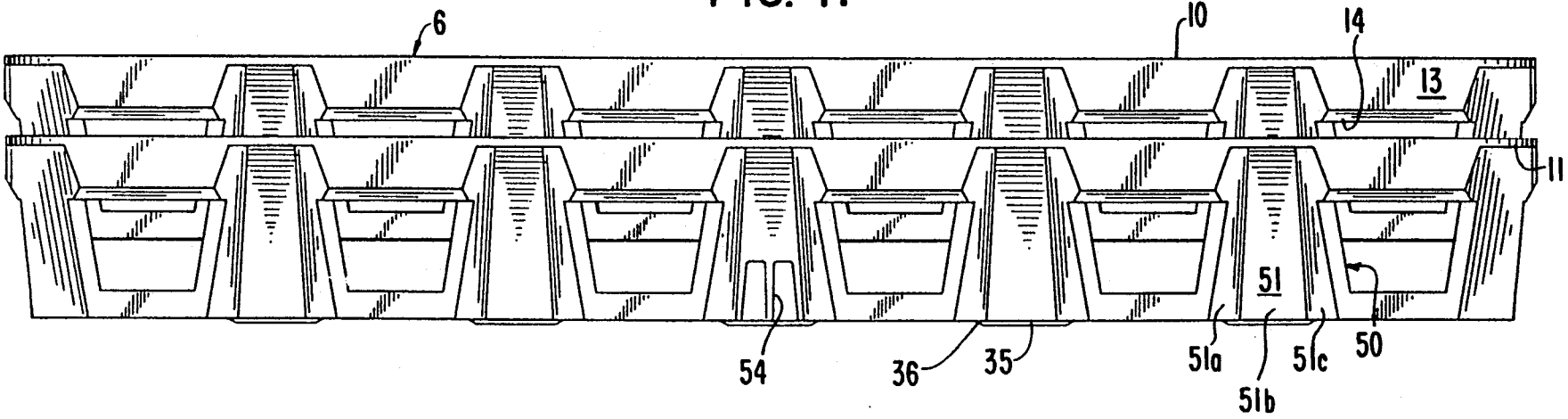
FIG. 17 is an elevational view of two nested trays.

Referring to FIGS. 1, 3 and 12, the floor top surface 21 may also have a nesting nub 25, preferably disposed generally in the geometric center of the floor top surface 21. The nesting nub 25, in conjunction with certain structural features on the columns 50, acts as a support for the weight of trays nested above. The nub 25 can be of any shape and is preferably generally ovoid in cross section. The height of the nub 25 is determined so that when the trays are in a nested arrangement as shown in FIG. 17, the band I 0 of the tray above clears the top edge of the tray below.

Figure 6:
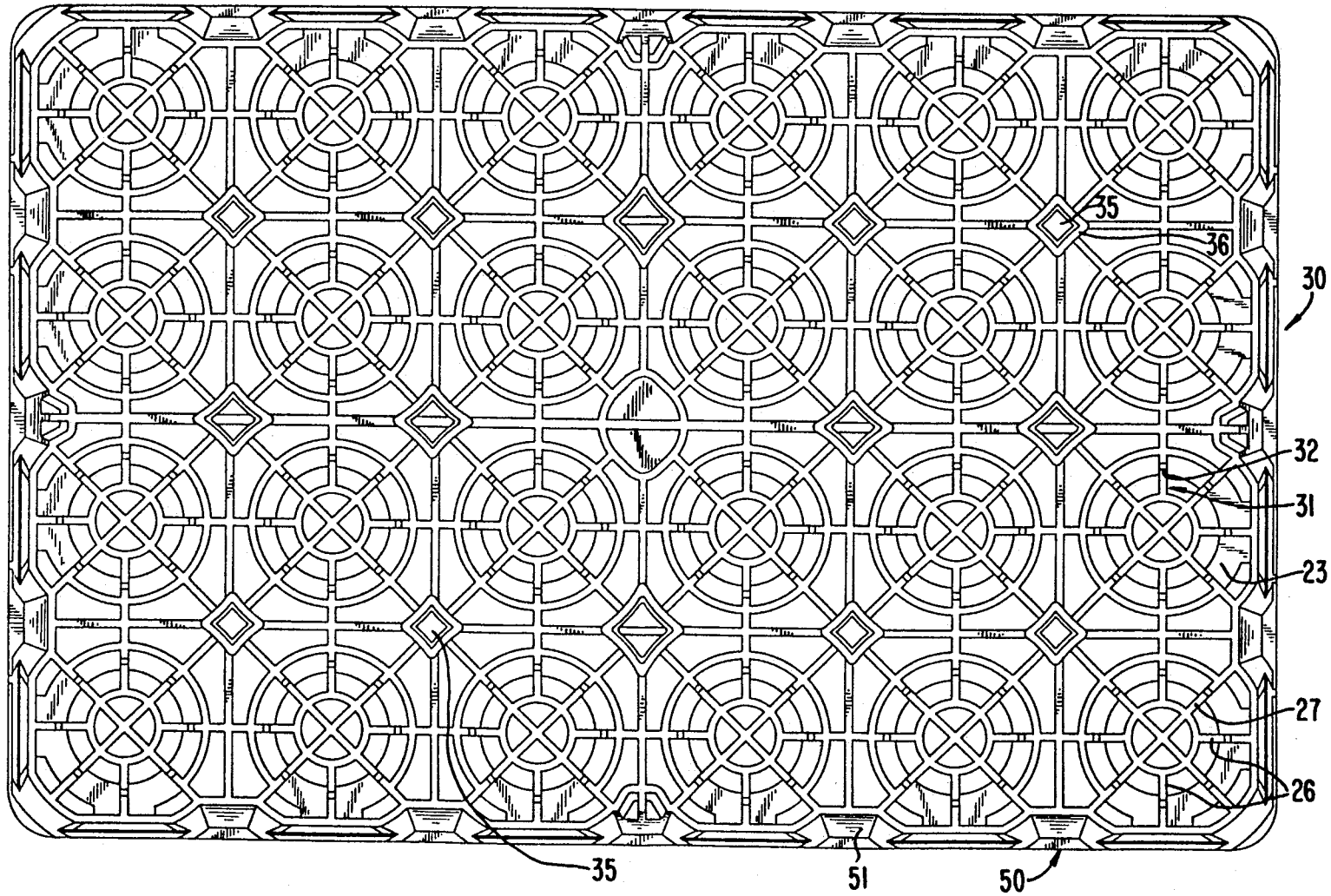
FIG. 6 is a bottom plan view of the tray.

The floor 20 has a bottom surface 30 which has distinctive structural features. Firstly, for the nested configuration, the floor bottom surface 30 may have a nub support surface 33 which is opposite the nub 25 as shown in FIGS. 6 and 12. The nub support 33 rests on the nub of an empty tray below when two trays are nested as shown in FIG. 17. Secondly, the floor bottom surface 30 is configured to allow for cross-stacking of trays. Cross-stacking is done by rotating a top tray 90 degrees about a vertical axis and lowering onto a bottom tray or trays. During shipping and handling trays may be moved by machines and it is advantageous to use trays which can be stacked or cross-stacked. Additionally, when the trays are used to display the containers in a retail setting, the retailer may wish to cross-stack the trays for display or space reasons. The floor bottom surface 30 has structural features which help hold the tray securely on other trays beneath when stacked and cross-stacked. Thirdly, when a tray is loaded and stacked or cross-stacked above a similarly loaded tray, the tops of the cans or bottles in the tray beneath are loosely retained in position by the floor bottom surface of the tray above. The floor bottom surface of the present invention has the necessary features to accommodate the retention of the tops of both cans and bottles.

Figure 7:
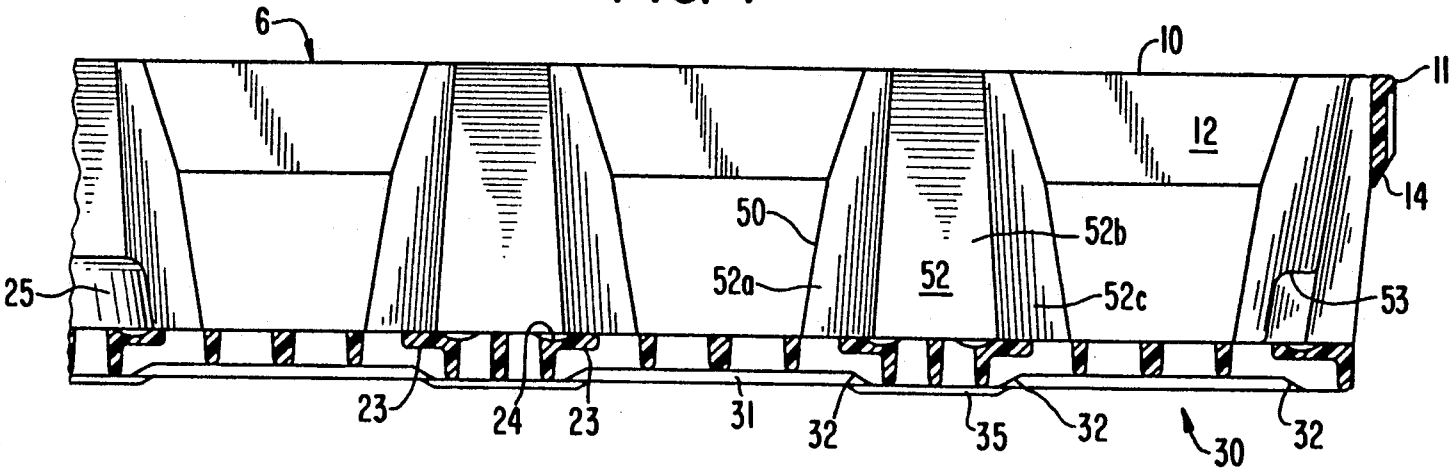
FIG. 7 is a cross section taken along line 7—7 of FIG. 3.
Figure 8:
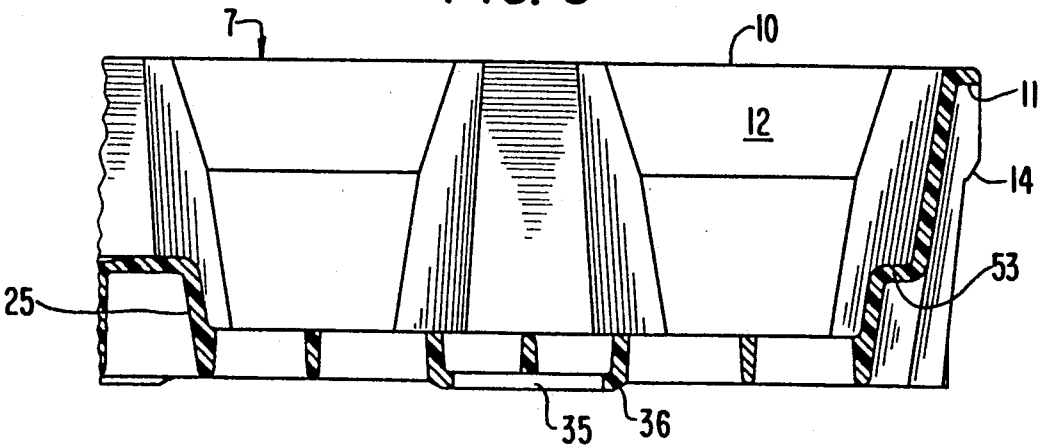
FIG. 8 is a cross section taken along line 8—8 of FIG. 3.
Figure 11:
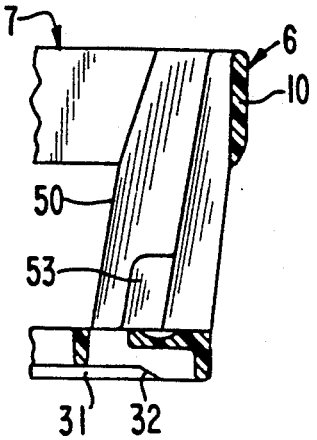
FIG. 11 is a cross section taken along line 11—11 of FIG. 3.
Figure 16:
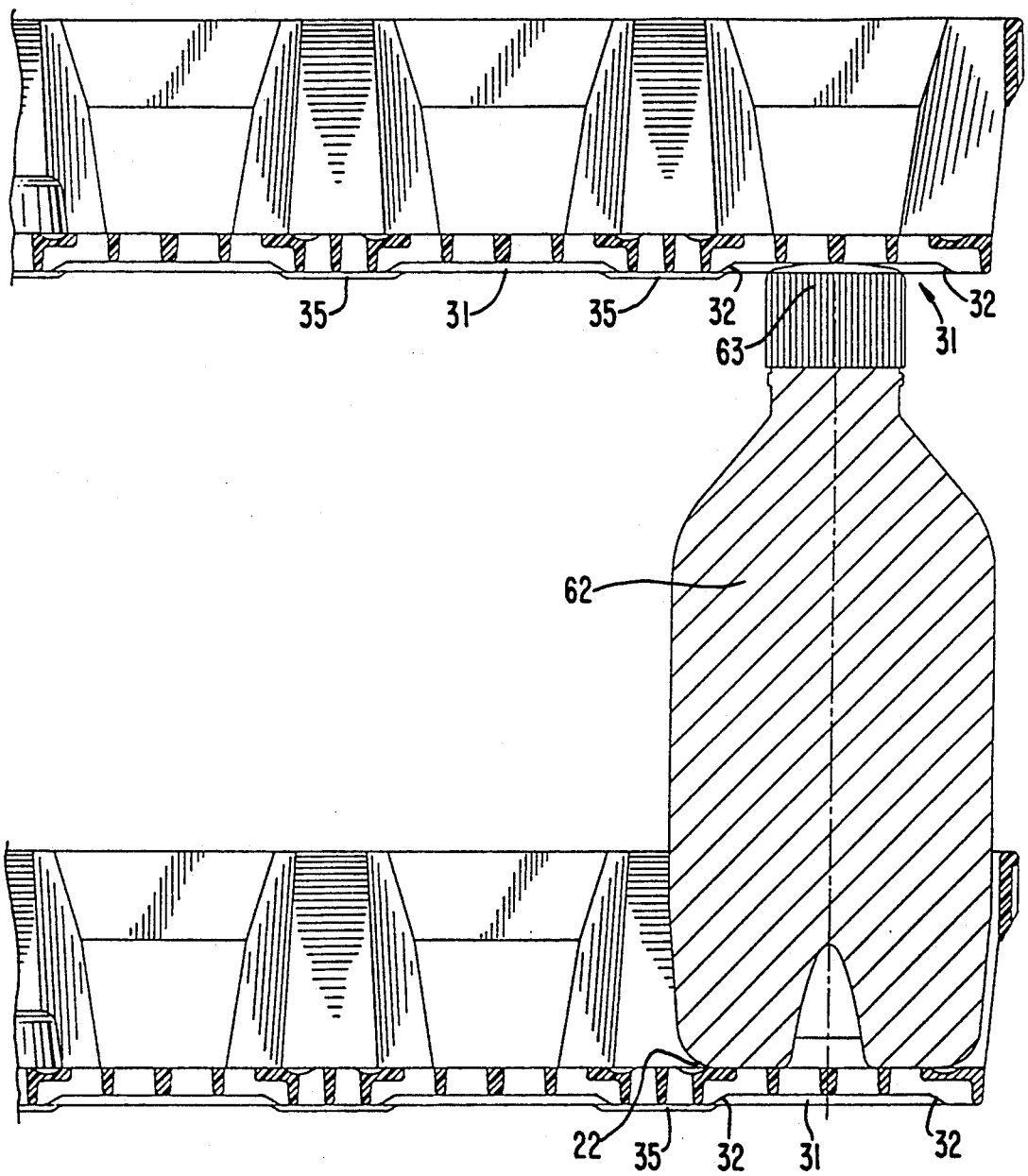
FIG. 16 is a partial elevational view of a tray stacked on top of another tray loaded with a bottle.

For accommodating bottles, the floor bottom surface 30 has a plurality of upward recesses 31 generally centered below each support area 22. These recesses are shown in FIGS. 6, 7, 11 and 16. Each recess 31 is formed simply by having material removed from the bottom surfaces of the support areas 22, prefer-ably from the bottom surfaces of the perpendicular struts 26 and radial struts 27. Any other bottom structure near the center of the support area 22 would also have material removed to form the recess 31. Recess edges 32 in FIGS. 7 and 11 illustrate the points at which tray material has been removed to form the recesses 31. The recessed receiving areas or recesses 31 are designed to loosely contain the tops of bottles 62 loaded in a tray below as shown in FIG. 16. The recesses 31 with recess edges 32 provide receiving areas for the tops 63 of bottles 62. The recesses 31 are sized to allow clearances for both stacking loaded trays of bottles in a column and cross-stacking.

Figure 14:
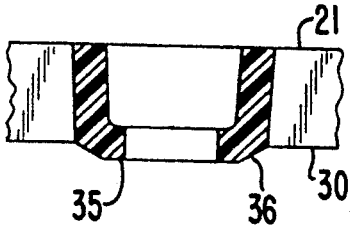
FIG. 14 is a cross section taken along line 14—14 of FIG. 3.

For accommodating cans, the floor bottom surface 30 also has a plurality of downwardly projecting redoubts 35 which are preferably diamond-shaped when viewed from above or below as in FIGS. 3 and 6. The preferred diamond shape is best suited for the present dual purpose tray since that shape accommodates the tops of cans but does not substantially effect the handling of trays loaded with bottles. Of course the redoubts 35 may be of any suitable shape to achieve the objects of the invention. Referring to FIGS. 7, 8, 14 and 15, the redoubts 35 project downwardly from the floor bottom surface 30 and are positioned between support areas 22. FIG. 14 illustrates a cross section of a redoubt 35 and it can be seen that the outer edges may be contoured and preferably are beveled as at 36.

The redoubts 35 both help hold loaded and stacked trays in a blocked position, and facilitate movement of an upper tray along the tops of cans in a lower tray in an unblocked position. The blocked position refers to when loaded trays are firmly stacked or cross-stacked with the redoubts 35 disposed between the tops of containers in the lower tray. In the blocked position, the upper tray is effectively blocked from moving along the tops of the containers by the downwardly projecting redoubts 35 which are disposed between the containers beneath and resist sliding movement of the upper tray. On the other hand, the redoubts 35 also help the upper tray to slide when it has been unblocked from the tops of the lower cans. To unblock a loaded tray from a lower loaded tray, a positive twist or rotation of the upper tray about a vertical axis causes the upper tray to ride up the redoubts' beveled surfaces 36 onto the tops of cans below and thus the lowermost surfaces of the redoubts 35 of the upper tray can slide freely on the tops of cans below. In the unblocked position, the redoubts 35 provide a sliding surface so that a loaded tray can be easily slid along the tops 59 of cans 58 loaded in a similar tray below without having to be lifted. The use of the redoubts 35 to move trays along other trays below facilitates shipping and handling. It should be noted that the redoubts 35 are placed so that if the tray is not in either the stacked or cross-stacked positions, at least some of the redoubts are always on the tops of the cans thereby preventing the top tray from falling into the blocked position. Only the stacked or cross-stacked positions are blocked positions. Once the top tray is unblocked, the redoubts 35 prevent blocking in all but the stacked or cross-stacked configurations. The redoubts 35 are also positioned on the floor bottom surface 30 so as not to impede cross-stacking of loaded trays of either cans or bottles. They are also designed with a clearance for cans which do not line up exactly in their support areas.

The columns 50 along the side wails of the tray 1 which connect the floor 20 to the band 10 are positioned between adjacent the support areas 22 at the outermost edges of the floor 20. The height of the columns 50 is sufficient enough to prevent the containers from tipping when transported and handled. The columns 50 are low enough, however, so that the tops of the containers extend above the band 10 and a stack of nested trays take up minimal vertical space. As shown in FIG. 17, each empty tray adds only the height of its band to a nested stack of trays.

The exterior surfaces of the columns 50 include slots 51. The slots are configured to receive the inwardly disposed surfaces 52 of the columns 50 when nested. The inward surfaces 52 are generally vertical and preferably have three angled faces **52*a*, 52*b*, 52*c* which would mate in the corresponding slot 51 having mating angled surfaces 51*a*, 51*b* and 51*c* as shown in FIGS. 4, 7, 9 and 17. The slots 51 receive the inward surfaces 52** of columns of another tray to provide a deeply nested arrangement.

As best shown in FIGS. 1–5, 8 and 10, nesting ledges 53 and vertical ribs 54 are preferably disposed on at least one column of each side wall. Preferably the center column of each side wall includes the nesting ledge 53 and vertical rib 54. The nesting ledge 53 is a shelf-like structure which projects inwardly from the middle face of the column **52*b*. The ledge 53 is equal in height to the nesting nub 25, and also acts as a support for the weight of empty trays nested above. The external vertical rib 54 of an upper tray which is disposed in the slot of the same column as its ledge 53 rests on the internal ledge of a lower tray when the trays are nested. The rib 54 is also substantially equal in height to the ledge and nub, and integral with the middle face 51*b* of the slot 51. The rib 54 is flush with the face 51*b* so as not to disrupt the mating relationship between the slot and inward portion of the column below. Of course any number of nesting ledges and corresponding vertical ribs is possible in order to distribute the weight of the trays nested above. With the nub 25 and the ledges 53 supporting the weight of nested trays, the trays maintain their structural integrity and will have a longer service life. Additionally, having the nub 25 and ledges 53** to support the weight of trays nested above prevents the wall structures of the trays from fraying outward and thereby increasing the possibility of shingling.

The preferred embodiment of the present invention comprises ledges and a central nub, but a tray with only ledges to support the weight of nested trays is within the scope of the invention. Moreover, a tray with only a nub or with a different placement of the nub or plural nubs with or without ledges is also within the scope of the invention.

The columns 50, in addition to their nestability function, must also be substantial enough to support the top band 10 so that the tray 1 does not break apart when the containers push against the band 10. The columns 50 preferably have a pyramidal design allowing them to have the largest area at their bottoms, making it unlikely that they will be tom away from the floor 20 in the event of a severe impact. The columns 50 of the present tray 1 are disposed between the container support areas which are along the periphery of the tray. By this placement of the columns 50, excessive contact with the containers during normal tray handling, and any resultant damage, is avoided.

Although the invention has been described with reference to particular embodiments, it is to be understood that the invention is limited only by the following claims.

We claim:

1. A low depth tray for cylindrical containers adapted to be nested with other trays when empty of the containers and stacked with other trays when loaded with the containers, said tray comprising:

a low depth wall structure comprising a band extending around the periphery of said tray for preventing the cylindrical containers from tipping during transport;

a floor structure comprising, a floor top surface comprising a plurality of support areas for supporting the containers thereon, and at least one nub disposed on said floor top surface, and a floor bottom surface comprising a plurality of upward recesses generally centered below said support areas, a plurality of spaced downward redoubts generally disposed between said support areas and adapted to be positioned between the containers in another tray therebeneath in order to block the low depth tray from free sliding when in a loaded and stacked position, and a nub support surface centered below each said nub; and a plurality of columns along each side of said wall structure, said columns interconnecting said band and said floor structure, at least one of said columns along each side of said wall structure, including an inwardly projecting nesting ledge equal in height to said nub, said nesting ledge projecting inward from said column between said support areas, the outside of said column with said nesting ledge having a vertical rib equal in height to said nesting ledge, said plurality of columns configured to nest deeply with columns of another empty tray;

wherein said nub support surface and said vertical ribs are adapted to be supported by the nub and the nesting ledges, respectively, of another tray when the low depth tray is empty and nested with another tray therebeneath, and to support the weight of any trays nested above the low depth tray, to thereby prevent fraying of said wall structure of the low depth tray.

2. The low depth tray of claim 1, wherein said upward recesses in said floor bottom surface have beveled surfaces around their peripheries so as to encircle and loosely contain the tapered top surfaces of containers in another tray therebeneath when in a loaded and stacked position to prevent excess movement of the containers from their respective support areas.

3. The low depth tray of claim 2, wherein said upward recesses in said floor bottom surface are adapted to encircle and loosely contain the top surfaces of containers in another tray when in a loaded and cross-stacked configuration, the cross-stacked configuration being rotated about a vertical axis approximately 90 degrees from the stacked configuration.

4. The low depth tray of claim 1, wherein said nub is disposed in the center of said floor top surface.

5. The low depth tray of claim 1, wherein said nesting ledges and vertical ribs are disposed on the center ones of said columns along each side of said wall structure.

6. The low depth tray of claim 1, wherein said spaced downward redoubts on said floor bottom surface are adapted to block said tray from free sliding along the tops of containers of another tray therebeneath when in a loaded and stacked position, and wherein the outer edges of each said redoubts are contoured surfaces.

7. The low depth tray of claim 1, wherein said spaced downward redoubts on said floor bottom surface are adapted to block said tray from free sliding along the tops of containers of another tray therebeneath when in a loaded and stacked position, and wherein the outer edges of each of said redoubts are beveled surfaces such that a slight rotation of said tray about a generally vertical axis causes said redoubts to disengage from the top surfaces of the containers therebeneath and thereby permitting the containers to ride up said beveled surfaces allowing free sliding of the low depth tray on the top surfaces of the containers.

8. The low depth tray of claim 7, wherein said spaced downward redoubts are positioned interstitially to be adaptable for cross-stacking loaded trays, the cross-stacked configuration being rotated about a vertical axis approximately 90 degrees from the stacked configuration

9. The low depth tray of claim 8, wherein said redoubts are adapted to be between the containers in a tray therebeneath only when in a blocked position, such blocked position being either a stacked configuration or a cross-stacked configuration.

10. The low depth tray of claim 1, further comprising a comer post at each comer of said wall structure of said tray for providing added support and containment of the containers.

11. The low depth tray of claim 1, wherein the lowermost edge of said band comprises a downwardly and inwardly inclined beveled surface adapted to cam said tray downward against the top of a band of another tray when placed in close relation so as to prevent shingling.

12. A low depth tray for holding either bottles or cans and adapted to be nested with other trays when empty of the bottles or cans and stacked with other trays when loaded with the bottles or cans, said tray comprising:

a low depth wall structure comprising a band extending around the periphery of said tray for preventing the bottles or cans from tipping during transport;

a floor structure comprising, a floor top surface comprising a plurality of support areas for supporting the bottles or cans thereon, and at least one nub disposed on said floor top surface, and a floor bottom surface comprising a plurality of upward recesses generally centered below said support areas, a plurality of spaced downward redoubts generally disposed between said support areas and adapted to be positioned between the bottles or cans in another tray therebeneath in order to block the low depth tray from free sliding when in a loaded and stacked position, and a nub support surface centered below each said nub; and a plurality of columns along each side of said wall structure, said columns interconnecting said band and said floor structure, at least one of said columns along each side of said wall structure, including an inwardly projecting nesting ledge equal in height to said nub, said nesting ledge projecting inward from said column between said support areas, the outside of said column with said nesting ledge having a vertical rib equal in height to said nesting ledge, said plurality of columns configured to nest deeply with columns of another empty tray;

wherein said nub support surface and said vertical ribs are adapted to be supported by the nub and the nesting ledges, respectively, of another tray when the low depth tray is empty and nested with another tray therebeneath, and to support the weight of any trays nested above the low depth tray, to thereby prevent fraying of said wall structure of the low depth tray.

13. The low depth tray of claim 12, wherein said upward recesses in said floor bottom surface have beveled surfaces around their peripheries so as to encircle and loosely contain the top surfaces of the bottles in another tray therebeneath when in a loaded and stacked position to prevent excess movement of the bottles from their respective support areas.

14. The low depth tray of claim 13, wherein said upward recesses in said floor bottom surface are adapted to encircle and loosely contain the top surfaces of containers in another tray when in a loaded and cross-stacked configuration, the cross-stacked configuration being rotated about a vertical axis approximately 90 degrees from the stacked configuration.

15. The low depth tray of claim 12, wherein said nub is disposed in the center of said floor top surface.

16. The low depth tray of claim 12, wherein said nesting ledges and vertical ribs are disposed on the center ones of said columns along each side of said wall structure.

17. The low depth tray of claim 12, wherein said spaced downward redoubts on said floor bottom surface are adapted to block said tray from free sliding along the tops of the cans of another tray therebeneath when in a loaded and stacked position, and wherein the outer edges of each said redoubts are contoured surfaces.

18. The low depth tray of claim 12, wherein said spaced downward redoubts on said floor bottom surface are adapted to block said tray from free sliding along the tops of the cans of another tray therebeneath when in a loaded and stacked position, and wherein the outer edges of each said redoubts are beveled surfaces such that a slight rotation of said tray about a generally vertical axis causes said redoubts to disengage from the top surfaces of the cans therebeneath and thereby permitting the cans to ride up said beveled surfaces allowing free sliding of the low depth tray on the top surfaces of the cans.

19. The low depth tray of claim 18, wherein said spaced downward redoubts are positioned interstitially to be adaptable for cross-stacking loaded trays, the cross-stacked configuration being rotated about a vertical axis approximately 90 degrees from the stacked configuration.

20. The low depth tray of claim 12, wherein said redoubts are adapted to be between the cans in a tray therebeneath only when in a blocked position, such blocked position being either a stacked configuration or a cross-stacked configuration.

21. A low depth tray for holding bottles adapted to be nested with other trays when empty of the bottles and stacked with other trays when loaded with the bottles, said tray comprising:

a low depth wall structure comprising a band extending around the periphery of said tray for preventing the bottles from tipping during transport;

a floor structure comprising, a floor top surface comprising a plurality of support areas for supporting the bottles thereon, and at least one nub disposed on said floor top surface, and a floor bottom surface comprising a plurality of upward recesses generally centered below said support areas, said upward recesses having beveled surfaces around their peripheries so as to loosely contain the tops of the bottles in another tray therebeneath to prevent excess movement of the bottles from their respective support areas, and a nub support surface centered below each said nub; and a plurality of columns along each side of said wall structure, said columns interconnecting said band and said floor structure, at least one of said columns along each side of said wall structure, including an inwardly projecting nesting ledge equal in height to said nub, said nesting ledge projecting inward from said column between said support areas, the outside of said column with said nesting ledge having a vertical rib equal in height to said nesting ledge, said plurality of columns configured to nest deeply with columns of another empty tray;

wherein said nub support surface and said vertical ribs are adapted to be supported by the nub and the nesting ledges, respectively, of another tray when the low depth tray is empty and nested with another tray therebeneath, and to support the weight of any trays nested above the low depth tray, to thereby prevent fraying of said wall structure of the low depth tray.

22. The low depth tray of claim 21, wherein said upward recesses in said floor bottom surface are adapted to encircle and loosely contain the top surfaces of containers in another tray when in a loaded and cross-stacked configuration, the cross-stacked configuration being rotated about a vertical axis approximately 90 degrees from the stacked configuration.

23. The low depth tray of claim 21, wherein said nub is disposed in the center of said floor top surface.

24. The low depth tray of claim 21, wherein said nesting ledges and vertical ribs are disposed on the center ones of said columns along each side of said wall structure.

25. A low depth tray for holding cans adapted to be nested with other trays when empty of the cans and stacked with other trays when loaded with the cans, said tray comprising:

a low depth wall structure comprising a band extending around the periphery of said tray for preventing the cans from tipping during transport;

a floor structure comprising, a floor top surface comprising a plurality of support areas for supporting the cans thereon, each said support area including a relatively shallow circular groove for engaging the bottoms of the cans, and at least one nub disposed on said floor top surface, and a floor bottom surface comprising a plurality of spaced downward redoubts generally disposed between said support areas and adapted to be positioned between the cans in another tray therebeneath in order to block the low depth tray from free sliding when in a loaded and stacked position, and a nub support surface centered below each said nub; and a plurality of columns along each side of said wall structure, said columns interconnecting said band and said floor structure, at least one of said columns along each side of said wall structure, including an inwardly projecting nesting ledge equal in height to said nub, said nesting ledge projecting inward from said column between said support areas, the outside of said column with said nesting ledge having a vertical rib equal in height to said nesting ledge, said plurality of columns configured to nest deeply with columns of another empty tray;

wherein said nub support surface and said vertical ribs are adapted to be supported by the nub and the nesting ledges, respectively, of another tray when the low depth tray is empty and nested with another tray therebeneath, and to support the weight of any trays nested above the low depth tray, to thereby prevent fraying of said wall structure of the low depth tray.

26. The low depth tray of claim 25, wherein said downward redoubts in said floor bottom surface are adapted to allow for cross-stacking of a loaded tray.

27. The low depth tray of claim 25, wherein said redoubts are adapted to be between the cans in a tray therebeneath only when in a blocked position, such blocked position being either a stacked configuration or a cross-stacked configuration, the cross-stacked configuration being rotated about a vertical axis approximately 90 degrees from the stacked configuration.

28. The low depth tray of claim 25, wherein said nub is disposed in the center of said floor top surface.

29. The low depth tray of claim 25, wherein said nesting ledges and vertical ribs are disposed on the center ones of said columns along each side of said wall structure.

30. The low depth tray of claim 25, wherein said spaced downward redoubts on said floor bottom surface are adapted to block said tray from free sliding along the tops of the cans of another tray therebeneath when in a loaded and stacked position, and wherein the outer edges of each said redoubts are contoured surfaces.

31. The low depth tray of claim 25, wherein said spaced downward redoubts on said floor bottom surface are adapted to block said tray from free sliding along the tops of the cans of another tray therebeneath when in a loaded and stacked position, and wherein the outer edges of each said redoubts are beveled surfaces such that a slight rotation of said tray about a generally vertical axis causes said redoubts to disengage from the top surfaces of the cans therebeneath and thereby permitting the cans to ride up said beveled surfaces allowing free sliding of the low depth tray on the top surfaces of the cans.

32. A low depth tray for cylindrical containers adapted to be nested with other trays when empty of the containers and stacked with other trays when loaded with the containers, said tray comprising:

a low depth wall structure comprising a band extending around the periphery of said tray for preventing the cylindrical containers from tipping during transport;

a floor structure comprising, a floor top surface comprising a plurality of support areas for supporting the containers thereon, and at least one nub disposed on said floor top surface, and a floor bottom surface comprising a plurality of upward recesses generally centered below said support areas, a plurality of spaced downward redoubts generally disposed between said support areas and adapted to be positioned between the containers in another tray therebeneath in order to block the low depth tray from free sliding when in a loaded and stacked position, and a nub support surface centered below each said nub; and a plurality of columns along each side of said wall structure, said columns interconnecting said band and said floor structure, said plurality of columns configured to nest deeply with columns of another empty tray;

wherein said nub support surface is adapted to be supported by the nub, of another tray when the low depth tray is empty and nested with another tray therebeneath, and to support the weight of any trays nested above the low depth tray, to thereby prevent fraying of said wall structure of the low depth tray.

33. A low depth tray for cylindrical containers adapted to be nested with other trays when empty of the containers and stacked with other trays when loaded with the containers, said tray comprising:

a low depth watt structure comprising a band extending around the periphery of said tray for preventing the cylindrical containers from tipping during transport;

a floor structure comprising, a floor top surface comprising a plurality of support areas for supporting the containers thereon, and a floor bottom surface comprising a plurality of upward recesses generally centered below said support areas, a plurality of spaced downward redoubts generally disposed between said support areas and adapted to be positioned between the containers in another tray therebeneath in order to block the low depth tray from free sliding when in a loaded and stacked position; and a plurality of columns along each side of said wall structure, said columns interconnecting said band and said floor structure, at least one of said columns along each side of said wall structure, including an inwardly projecting nesting ledge, said nesting ledge projecting inward from said column between said support areas, the outside of said column with said nesting ledge having a vertical rib equal in height to said nesting ledge, said plurality of columns configured to nest deeply with columns of another empty tray;

wherein said vertical ribs are adapted to be supported by the nesting ledges of another tray when the low depth tray is empty and nested with another tray therebeneath, and to support the weight of any trays nested above the low depth tray, to thereby prevent fraying of said wall structure of the low depth tray.

* * * * *

UNITED STATES PATENT AND TRADEMARK OFFICE

CERTIFICATE OF CORRECTION

PATENT NO. : 5,305,884
DATED : April 26, 1994
INVENTOR(S) : William P. Apps et al.

It is certified that error appears in the above-identified patent and that said Letters Patent is hereby corrected as shown below:

Column 9, claim 8,
Lines 58-59, after "configuration" insert -- . --.

Column 9, claim 10,
Line 66, after "a" delete "comer" and insert therefor -- corner --; and after "each" delete "comer" and insert therefor -- corner --.

Column 14, claim 33,
Line 14, delete "watt" and insert therefor -- wall --.

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*